US009909475B2

(12) United States Patent
Yokoo et al.

(10) Patent No.: US 9,909,475 B2
(45) Date of Patent: Mar. 6, 2018

(54) EGR COOLER

(71) Applicant: Tokyo Radiator MFG. Co., Ltd., Fujisawa-shi, Kanagawa (JP)

(72) Inventors: Tetsu Yokoo, Fujisawa (JP); Toshihito Nakanowatari, Fujisawa (JP); Toshikazu Kodama, Fujisawa (JP); Kazuya Okawara, Fujisawa (JP); Norihito Seki, Fujisawa (JP); Susumu Kozai, Fujisawa (JP); Isao Ayuse, Fujisawa (JP); Taketoshi Tamura, Fujisawa (JP); Kenta Semura, Fujisawa (JP)

(73) Assignee: Tokyo Radiator MFG. Co., Ltd., Fujisawa-shi, Kanagawa (JP)

( * ) Notice: Subject to any disclaimer, the term of this patent is extended or adjusted under 35 U.S.C. 154(b) by 686 days.

(21) Appl. No.: 14/361,872

(22) PCT Filed: Nov. 22, 2012

(86) PCT No.: PCT/JP2012/080386

§ 371 (c)(1),
(2) Date: May 30, 2014

(87) PCT Pub. No.: WO2013/080893

PCT Pub. Date: Jun. 6, 2013

(65) Prior Publication Data

US 2014/0318109 A1 Oct. 30, 2014

(30) Foreign Application Priority Data

Nov. 30, 2011 (JP) ..... 2011-261316

(51) Int. Cl.
*F01N 3/10* (2006.01)
*F28F 9/00* (2006.01)
(Continued)

(52) U.S. Cl.
CPC ..... *F01N 3/10* (2013.01); *F02M 26/32* (2016.02); *F28D 9/0031* (2013.01);
(Continued)

(58) Field of Classification Search
CPC ..... F01N 3/10; F02M 26/32; F28D 9/0031; F28D 9/0062; F28D 21/0003; F28F 1/006;
(Continued)

(56) References Cited

U.S. PATENT DOCUMENTS 1,993,872 A * 3/1935 Chase ..... F28D 1/0358 165/153
8,439,103 B2 * 5/2013 Reinders ..... F28D 9/0062 165/165
(Continued)

FOREIGN PATENT DOCUMENTS

DE 10060006 A1 6/2002
EP 2469211 A2 6/2012
(Continued)

OTHER PUBLICATIONS

International Search Report issued in corresponding International Application No. PCT/JP2012/080386 dated Feb. 26, 2013.
(Continued)

*Primary Examiner* — Tho V Duong
(74) *Attorney, Agent, or Firm* — Banner & Witcoff, Ltd.

(57) ABSTRACT

There is provided an EGR cooler having a core portion in which a large number of flat tubes through which exhaust gases pass are stacked one on another in an interior of a hollow cylindrical shell to be joined to the shell for heat exchange between the exhaust gases and a cooling fluid which flows around the tubes, a cylindrical inlet header which is joined to an upstream side of the shell in relation to a gas flow at one end thereof, and a cylindrical outlet
(Continued)

header which is joined to a downstream side of the core portion in relation to the gas flow at one end thereof, characterized in that the inlet header and the outlet header are joined to an outer surface of the shell, and the tubes are joined to an inner surface of the shell at those joint portions.

6 Claims, 9 Drawing Sheets

(51) Int. Cl.

| | |
|---|---|
| ***F28F 9/02*** | (2006.01) |
| ***F28F 9/18*** | (2006.01) |
| ***F28D 9/00*** | (2006.01) |
| ***F28D 21/00*** | (2006.01) |
| ***F28F 1/00*** | (2006.01) |
| ***F28F 3/02*** | (2006.01) |
| ***F28F 13/12*** | (2006.01) |
| ***F02M 26/32*** | (2016.01) |

(52) U.S. Cl.
CPC ..... *F28D 21/0003* (2013.01); *F28F 1/006* (2013.01); *F28F 3/025* (2013.01); *F28F 9/001* (2013.01); *F28F 9/0221* (2013.01); *F28F 9/182* (2013.01); *F28F 13/12* (2013.01); *F28F 2009/029* (2013.01); *F28F 2275/04* (2013.01)

(58) Field of Classification Search
CPC ..... F28F 1/42; F28F 1/40; F28F 3/025; F28F 3/027; F28F 9/001; F28F 9/0221; F28F 9/182; F28F 13/12; F28F 2275/04
See application file for complete search history.

(56) References Cited

U.S. PATENT DOCUMENTS

| | | | | |
|---|---|---|---|---|
| 8,708,036 | B2 | 4/2014 | Ikeda | |
| 2003/0010480 | A1* | 1/2003 | Shibagaki | F28D 7/1684 165/158 |
| 2008/0277105 | A1* | 11/2008 | Geskes | F02B 29/0462 165/162 |
| 2009/0173480 | A1* | 7/2009 | Huang | F28D 1/0391 165/152 |
| 2010/0319889 | A1 | 12/2010 | Ikeda | |

FOREIGN PATENT DOCUMENTS

| | | | | |
|---|---|---|---|---|
| JP | 01254377 | A | * | 10/1989 |
| JP | 2000161888 | A | * | 6/2000 |
| JP | 2001-336885 | A | | 12/2001 |
| JP | 2003-287382 | A | | 10/2003 |
| JP | 2009-019580 | A | | 1/2009 |
| JP | 2010-243125 | A | | 10/2010 |
| JP | 2011-002133 | A | | 1/2011 |
| WO | 2006/102736 | A1 | | 10/2006 |

OTHER PUBLICATIONS

Written Opinion issued in corresponding International Application No. PCT/JP2012/080386 dated Feb. 26, 2013.
Jul. 29, 2015—(EP) Partial Supplementary Search Report—App 12853489.8.
Jan. 2, 2018—(EP) Extended search report—App 17185644.6.

* cited by examiner

*FIG. 3A* *FIG. 3B*
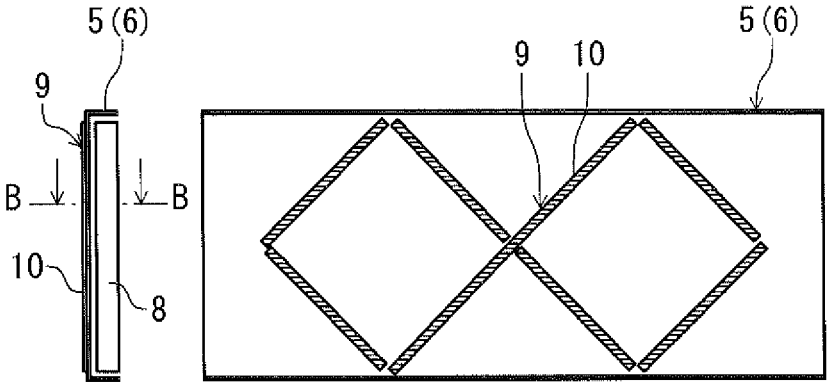
*FIG. 3C*
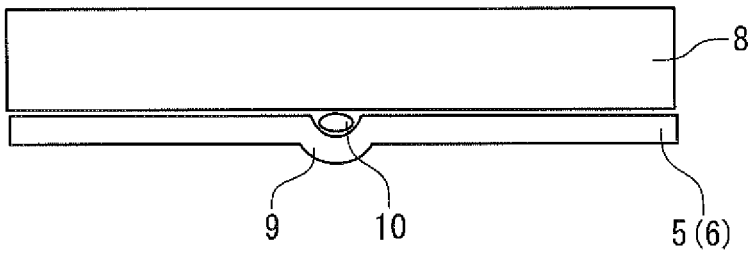

EGR COOLER

CROSS REFERENCE TO RELATED APPLICATIONS

The present application is a U.S. National Phase Application under 35 U.S.C. § 371 of International Application No. PCT/JP2012/080386, filed Nov. 22, 2012, which claims priority to Japanese Application 2011-261316 filed Nov. 30, 2011, which was published Under PCT Article 21(2). The entire contents of the aforementioned applications are hereby incorporated by reference.

TECHNICAL FIELD

The present invention relates to an EGR cooler which is used in an EGR system of, for example, a diesel vehicle which reduces the production of oxides of nitrogen (NOx) by returning part of exhaust gases to an induction system of an engine to cool the exhaust gases.

BACKGROUND ART

In a conventional EGR cooler, as shown in FIGS. 7A and 7B, a large number of tubes 4 are disposed in an interior of a shell 7 which is formed into a large-diameter angularly cylindrical shape, and interiors of the tubes 4 constitute gas flow paths, while a space defined between the shell 7 and the tubes 4 constitutes a cooling fluid path. The gas flow paths and the cooling fluid flow path are joined together so as to maintain gas and fluid tightness therebetween.

A cooling fluid inlet pipe 11 is attached to a lower surface portion of the shell 7, while a cooling fluid outlet pipe 12 is attached to an upper surface portion of the shell 7, whereby a cooling fluid passes through the interior of the shell 7 from the cooling fluid inlet pipe 11 to the cooling fluid outlet pipe 12.

Additionally, an inlet header 2 and an outlet header 3 are attached to both longitudinal ends of the shell 7, and exhaust gases flow from the inlet header 2 while being divided into the large number of tubes 4 and are discharged from the outlet header 3.

In a core portion 1 of the shell 7 where the tubes 4 are housed, heat exchange is performed between the exhaust gases and the cooling fluid via the tubes, whereby the exhaust gases are cooled.

As shown in FIGS. 7A, 7B and 9, the tube 4 is a flat tube which is a combination of a tube inner 5 and a tube outer 6 which are disposed to face opposite each other. In order for the tubes 4 to be disposed stacked one on another with a space maintained therebetween, swollen portions 5*a*, 6*a* which are swollen in a thickness direction are formed at inlet portions and outlet portions thereof (Patent Document 1).

Additionally, as shown in FIGS. 8A to 8C, an inner fin 8 is housed in an interior of the tube 4 so as to be joined thereto to thereby increase a heat exchanging area so as to promote the heat exchange.

PRIOR ART DOCUMENT

Patent Document

Patent Document 1: JP-A-2010-243125

SUMMARY OF THE INVENTION

Problems that the Invention is to Solve

It is effective to increase the volume of the core portion 1 where the heat exchange is performed in order to enhance the cooling performance of the EGR cooler. However, the layout of parts in an engine compartment of the vehicle where the EGR cooler is installed is limited in many ways, and this has prevented the introduction of a large EGR cooler. Because of this, it has been considered to increase the ratio of the volume of the core portion 1 to the whole volume of the EGR cooler by decreasing the ratio of the volumes of portions 14 (refer to FIG. 2A) such as the headers which do not contribute to the heat exchange.

However, in the conventional EGR cooler, as shown in FIG. 7B, a joint portion 15 where the header and the shell are joined together and a joint portion 16 where the shell and the tube are joined together are formed, and the dimensions of these joint portions 15, 16 cannot be decreased from the view point of ensuring the strengths of the joint portions. This requires that the ratio of the core portion 1 to the whole of the EGR cooler should be decreased as the EGR cooler is decreased in size, resulting in a problem that the cooling performance of the EGR cooler is decreased.

Further, in the EGR cooler, since both the gas flow paths and the cooling fluid flow path are pressurized, a certain degree of pressure resistance strength is required on the constituent components and the joint portions thereof. For example, in the tubes 4, the pressure resistance strength is increased by housing the inner fin 8 in the interior thereof.

Additionally, in the joint portion 15 where the header and the shell are joined together and the joint portion 16 where the shell and the tube are joined together, the pressure resistance strength is ensured by overlapping the components to form a double-layer construction. However, since only the shell 7 exists between the two joint portions 15, 16, the pressure resistance strength thereat becomes insufficient, and the portion lying between the joint portions tends to be deformed easily. Thus, it has occurred from time to time that the thin tubes 4, the base material of the inlet header 2 (the outlet header 3), the base material of the shell 7 and the joint portion 15 between the header and the shell are pulled to be broken by the deformation. In this conventional construction, since the pressure resistance strength has not been able to be increased without increasing the thicknesses of both the inlet header 2 or the outlet header 3 and the shell 7, the material costs of the inlet header 2, the outlet header 3 and the shell 7 have been increased.

Further, in the EGR cooler of Patent Document 1, as shown in FIGS. 8A and 8B, since the inner fin 8 is housed in and joined to the tube 4, a brazing material 10 is applied to a whole area of an inner surface of a flat plate portion of each of a tube inner 5 and a tube outer 6. However, as shown in FIG. 8C, the thickness of the tube 4 is increased by the thickness of the brazing material 10, resulting in a problem that a predetermined number of tubes 4 cannot be housed in the interior of the shell 7.

Since the brazing material 10 is a paste which is a mixture of mineral powder and a liquid, it is difficult to control the thickness thereof.

Additionally, as shown in FIG. 9, in the conventional tubes 4, swollen portions 5*a*, 6*a* are provided on flat plate portions of both the tube inner 5 and the tube outer 6 in such a way as to be swollen in a thickness direction so as to hold spaces between the tubes 4 to thereby form fluid flow paths of the cooling fluid therebetween. Thus, both the tube inner 5 and the tube outer 6 come to have a complex shape, which increases the working cost and the material cost thereof.

The invention has been made with a view to solving the problems, and an object thereof is to provide an EGR cooler which enhances not only the cooling performance thereof by increasing the ratio of the volume of a core portion but also the pressure resistance strength thereof.

Another object of the invention is to provide an EGR cooler which can control the thickness of a tube which is increased by a brazing material which joins an inner surface of the tube and an inner fin together.

A further object of the invention is to provide an EGR cooler which can reduce the production cost of the tube.

Means for Solving the Problems

In the invention, the problems described above will be solved by the following means.

According to a first invention, there is provided an EGR cooler including: a core portion in which a plurality of tubes having a flat shape through which exhaust gases pass are stacked one on another in an interior of a hollow cylindrical shell to be joined to the shell, the core portion configured to heat exchange between the exhaust gases and a cooling fluid which flows around the tubes; an inlet header having a cylindrical shape and joined to an upstream side of the shell in relation to a gas flow at one end of the cylindrical inlet header, the inlet header configured to supply the exhaust gases into the core portion; and an outlet header having a cylindrical shape and joined to a downstream side of the core portion in relation to the gas flow at one end of the cylindrical outlet header, the outlet header configured to discharge the exhaust gases from the core portion, wherein the inlet header and the outlet header are joined to an outer surface of the shell, and the tubes are joined to an inner surface of the shell at those joint portions.

According to a second invention, one of the tubes houses an inner fin having a corrugated shape, the inner fin configured to produce a turbulence of the exhaust gases, and the one of the tubes includes a bead, in which a brazing material that connects the one of the tubes with the inner fin is provided, as a groove formed in an inner surface of the one of the tubes.

According to a third invention, one of the tubes is formed by combining a tube inner, in which internal walls are erected from both side edges of a flat plate portion, and a tube outer, in which external walls are erected from both side edges of a flat plate portion, and a swollen portion is formed at each longitudinal end of the flat plate portion of either of the tube inner and the tube outer, the swollen portion being swollen in a thickness direction and holding a space between an adjacent tube and the one of the tubes.

Advantageous Effects of the Invention

According to the first invention, the inlet header and the outlet header are joined to the outer surface of the shell, and the tubes are joined to the inner surface of the shell at the joint portions, whereby the ratio of the volumes of the headers and the joint portions which do not contribute to heat exchange can be reduced, while the ratio of the volume of the core portion can be increased, thereby making it possible to enhance the cooling performance of the EGR cooler.

In addition, the portion where only the shell having a poor pressure resistance exists is prevented from being provided between the joint portion between the shell and the inlet header (or the outlet header) and the joint portion between the shell and the tubes, and hence, the pressure resistance can be enhanced by the three-layer construction. Additionally, even when the pressure resistance is required to be increased by application conditions, the requirement of increasing the pressure resistance can be dealt with by increasing the thickness of only the inlet header or the outlet header, thereby making it possible to suppress the material cost.

According to the second invention, the one of the tubes houses the inner fin having a corrugated shape, the inner fin configured to produce a turbulence of the exhaust gases, and the one of the tubes includes the bead, in which the brazing material that connects the one of the tubes with the inner fin is provided, as the groove formed in the inner surface of the one of the tubes. This can not only reduce the amount of a brazing material used to reduce, in turn, the material cost but also prevent an increase in thickness of the tube due to the brazing material, thereby making it possible to enhance the accuracy of the resulting product.

According to the third invention, the one of the tubes is formed by combining the tube inner, in which internal walls are erected from both side edges of the flat plate portion, and the tube outer, in which external walls are erected from both side edges of the flat plate portion, and the swollen portion is formed at each longitudinal end of the flat plate portion of either of the tube inner and the tube outer, the swollen portion being swollen in a thickness direction and holding the space between the adjacent tube and the one of the tubes. This can reduce the total material cost and working cost which are needed to form the tube.

In addition, also when there is a change in specification in relation to the height of the cooling fluid flow path (the space between the tubes), only the shape of either of the tube inner and the tube outer on which the swollen portions are provided (the height of the swollen portions) should be changed, and hence, the shape of the other on which no swollen portion is provided does not have to be changed, and the mold used before the specification change can continue to be used, thereby making it possible to reduce or save the mold cost.

BRIEF DESCRIPTION OF THE DRAWINGS

FIGS. 3A and 3B show a tube of the EGR cooler, in which FIG. 3A is a side view of the tube, FIG. 3B is an explanatory plan view of the EGR cooler, and FIG. 3C is an explanatory sectional view taken along the line B-B in FIG. 3A.

FIGS. 8A to 8C show a tube of the conventional EGR cooler, in which FIG. 8A is a side view of the tube, FIG. 8B is an explanatory plan view of the tube, and FIG. 8C is an explanatory sectional view taken along the line D-D in FIG. 8A.

MODES FOR CARRYING OUT THE INVENTION

Hereinafter, an EGR cooler according to an embodiment of the invention will be described.

Figure 1:
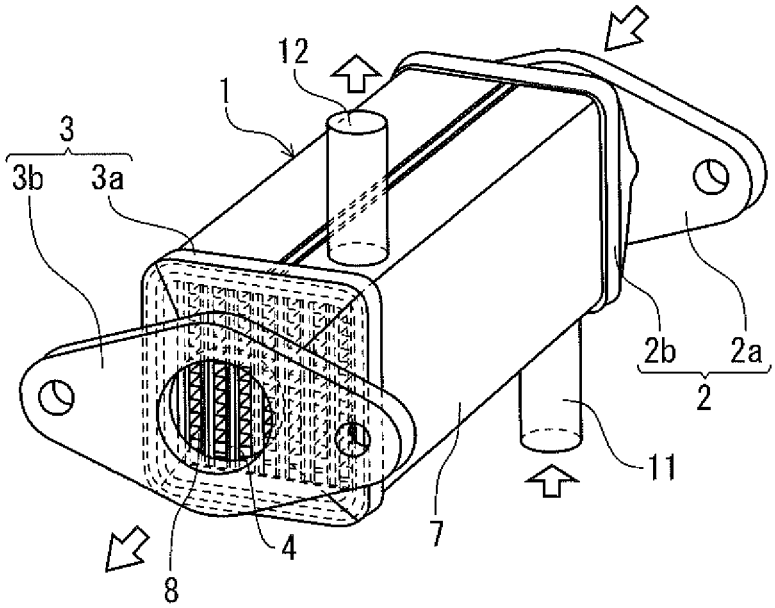
FIG. 1 is a perspective view showing an EGR cooler according to an embodiment of the invention.

As shown in FIG. 1, in this EGR cooler, an inlet header 2, from which exhaust gases from an exhaust system (not shown) of an engine is introduced, and an outlet header 3, from which the exhaust gases are discharged into an induction system (not shown) of the engine, are attached to both ends of a core portion 1 where a heat exchange is performed between the exhaust gases and a cooling fluid.

Figure 2A:
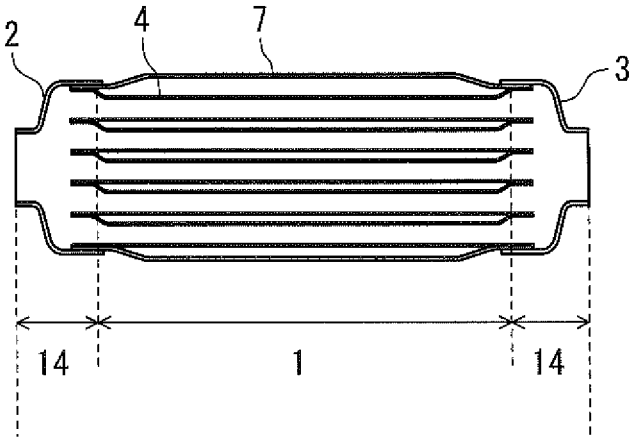
FIG. 2A is an explanatory sectional view of the EGR cooler.
Figure 2B:
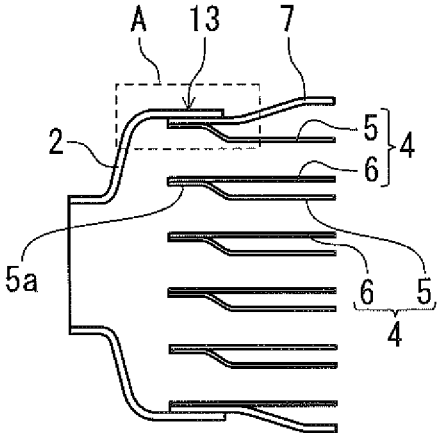
FIG. 2B is a partial enlarged view of FIG. 2A.
Figure 2C:
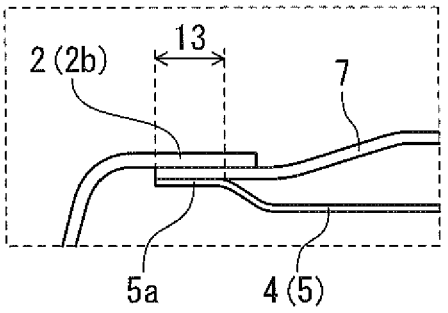
FIG. 2C is a partial enlarged view of a portion A in FIG. 2B.

As shown in FIGS. 2A to 2C, in this core portion 1, a large number of flat tubes 4 through which exhaust gases pass are stacked one on another with a space defined therebetween and are housed in an angularly cylindrical shell 7 to be joined fixedly thereto.

As shown in FIGS. 2A to 2C and 4, the tube 4 is formed into a hollow flat tube which is made up of a combination of a tube inner 5 in which inner side walls are provided on both side edges of a flat plate portion which is substantially flat in such a way as to stand erect therefrom and a tube outer 6 in which outer side walls are provided on both side edges of a flat portion which is substantially flat in such a way as to stand erect therefrom so as to contact the inner side walls.

The tube inner 5 and the tube outer 6 are joined together through brazing.

In this tube 4, a swollen portion 5*a* is formed at each longitudinal end of the tube inner 5 in such a way that the flat plate portion is swollen in a thickness direction. The swollen portion 5*a* and the other portion of the flat portion are connected by a slope. Because of this, when the large number of tubes 4 are stacked one on another, the swollen portions 5*a* are brought into abutment with the adjacent tube 4, whereby a predetermined space, which constitutes a cooling fluid flow path, is defined between the tubes 4 lying adjacent to each other.

On the other hand, no swollen portion is provided on the tube outer 6, and the flat portion is formed flat over the whole area of the flat plate portion along a longitudinal direction thereof (excluding a case where a bead 9 is formed as will be described later).

As shown in FIGS. 1 and 3A to 3C, a corrugated inner fin 8 is housed in each tube 4, whereby exhaust gases which pass through the tube 4 are dispersed, merged or snaked to be made turbulent. Additionally, a heat exchanging area between exhaust gases and a cooling fluid is increased by the inner fin 8, thereby promoting the heat exchange therebetween.

The inner fin 8 is housed in the tube 4 and is joined to an inner surface of the tube 4 through brazing.

As shown in FIGS. 3A to 3C, a plurality of linear beads 9 are provided on the flat portion of each of the tube inner 5 and the tube outer 6 so as to form a plurality of grooves in an inner surface of the flat portion, and as a whole, the linear beads 9 constitute sides of two squares which contact each other at corresponding corners.

When joining the inner fin 8 to the tube 4, a brazing material 10 is applied to the grooves formed as a result of the provision of the beads 9 of the tube inner 5 and the tube outer 6. Following this, the inner fin 8 is set in a predetermined position, and the tube inner 5 and the tube outer 6 are combined together and are then heated to be brazed together via the inner fin 8.

As shown in FIG. 1, the shell 7 is made by joining together two U-shaped sheet materials and is formed into an angularly cylindrical shape having opening portions at both ends thereof so that the number of plate tubes 4, 4 which are stacked one on another can be housed therein. Additionally, a cooling fluid inlet pipe 11 and a cooling fluid outlet pipe 12 are connected to a lower surface portion at an inlet side and an upper surface portion at an outlet side of the shell 7, respectively.

The inlet header 2 which is attached to an upstream side of the core portion 1 has a flange portion 2*a* which is connected to a piping (not shown) from the exhaust system of the engine and a downstream-side opening portion 2*b* having a large diameter which is joined to the shell of the core portion 1. The inlet header 2 is formed into a substantially angularly cylindrical shape which is expanded gradually in diameter towards the downstream-side opening portion 2*b*.

The outlet header 3 which is attached to a downstream side of the core portion 1 has an upstream-side opening portion 3*a* having a large diameter which is joined to the shell 7 of the core portion 1 and a flange portion 3*b* which is connected to a piping (not shown) to an induction system of the engine. The outlet header 3 is formed into a substantially angularly cylindrical shape which is expanded gradually in diameter towards the upstream-side opening portion 3*a*.

As shown in FIGS. 2A to 2C, the downstream-side opening portion 2*b* of the inlet header 2 is formed larger in diameter than an upstream-side end portion of the shell 7 and is joined to an outer surface of the shell 7 at a joint portion 13.

Similarly, the upstream-side opening portion 3*a* of the outlet header 3 is formed larger in diameter than a downstream-side end portion of the shell 7 and is joined to the outer surface of the shell 7 at a joint portion 13.

On the other hand, the tubes 4 which are stacked one on another are jointed to an inner surface of the shell 7 at the joint portions 13, so that gas flow paths defined inside the tubes 4 and cooling fluid flow paths defined outside the tubes 4 are maintained in a gastight and fluid-tight fashion.

As shown in FIG. 2C, the inlet header 2 (the outlet header 3) is extended further towards the core portion 1 than the three-layer joint portion 13 where the inlet header 2 (the outlet header 3), the shell 7 and the tubes 4 are joined together to project over a portion of the shell 7 which constitutes a wall surface of the cooling fluid flow path.

Additionally, as shown in FIG. 2C, the tube 4 and the shell 7 have the same longitudinal length, and when assembling them together, longitudinal end faces of the tube 4 and the shell 7 are aligned with each other. Because of this, when assembling them together, the tube 4 and the shell 7 can easily be positioned in relation to each other by aligning the longitudinal end faces thereof with each other, which can enhance the productivity of EGR coolers.

In the EGR cooler configured in the way described above, the tubes 4 which are stacked one on another are joined to the inner surface of the shell 7 at the joint portions 13 where the inlet header 2 and the outlet header 3 are joined to the outer surface of the shell 7, whereby longitudinal lengths of portions 14 including the inlet header 2, the outlet header 3, the joint portions between the headers 2, 3 and the shell 7 and the joint portions between the shell 7 and the tubes 4 which do not contribute to heat exchange can be reduced to thereby increase the ratio of the volume of the core portion 1 in the EGR cooler. Thus, it is possible to enhance the cooling performance per the volume so ensured of the EGR cooler.

In addition, the inlet header 2 (the outlet header 3) is joined to the outer surface of the shell 7 and the tubes 4 are joined to the inner surface of the shell 7 at the same position (the joint portion 13) in relation to the longitudinal direction, whereby a three-layer construction is realized at the joint portion 13. Thus, a portion where only the shell 7 having a poor pressure resistance exists is prevented from being provided between the joint portion between the shell 7 and the inlet header 2 (the outlet header 3) and the joint portion between the shell 7 and the tubes 4, thereby making it possible to enhance the pressure resistance by the three-layer construction.

Additionally, even when the pressure resistance is required to be increased by application conditions, the requirement of increasing the pressure resistance can be dealt with by increasing the thickness of only the inlet header or the outlet header, thereby making it possible to suppress the material cost.

In addition, as shown in FIG. 2C, at the joint portion 13, the inlet header 2 (the outlet header 3) is extended further towards the core portion 1 than the three-layer joint portion 13 where the inlet header 2 (the outlet header 3), the shell 7 and the tubes 4 are joined together to project over a portion of the shell 7 which constitutes the wall surface of the cooling fluid flow path. Thus, the inlet header 2 (the outlet header 3) reinforces the shell 7 so as to enhance the pressure resistance against the cooling fluid.

Further, as shown in FIGS. 3A to 3C, the beads 9 are provided on the tube 4 so as to form the grooves in the inner surface of the tube 4 as a result of the provision of the tube and the inner fin 8 so that the brazing material 10 is laid out in the grooves, whereby the amount of brazing material 10 to be used can be reduced to an amount of brazing material 10 which is good enough to be laid out in the grooves formed as a result of the provision of the beads 9, thereby making it possible to reduce the material cost.

In addition, the grooves, which are formed as a result of provision of the beads 9, are filled with the brazing material 10, which is a paste made up of a mixture of mineral powder and a liquid, by an application robot or the like to join the tube 4 and the inner fin 8. Thus, there is no such situation that the brazing material 10 is accumulated on flat portions of the tube 4 other than the grooves resulting from the provision of the beads 9 to thereby increase the thickness of the tube 4, and a predetermined number of tubes 4 can be housed in the interior of the shell 7.

Additionally, since the beads 9 protrude from the tube 4 to the cooling fluid flow path (FIG. 3C), it is possible to produce turbulence in the cooling fluid so as to promote the heat exchanging performance.

Figure 4:
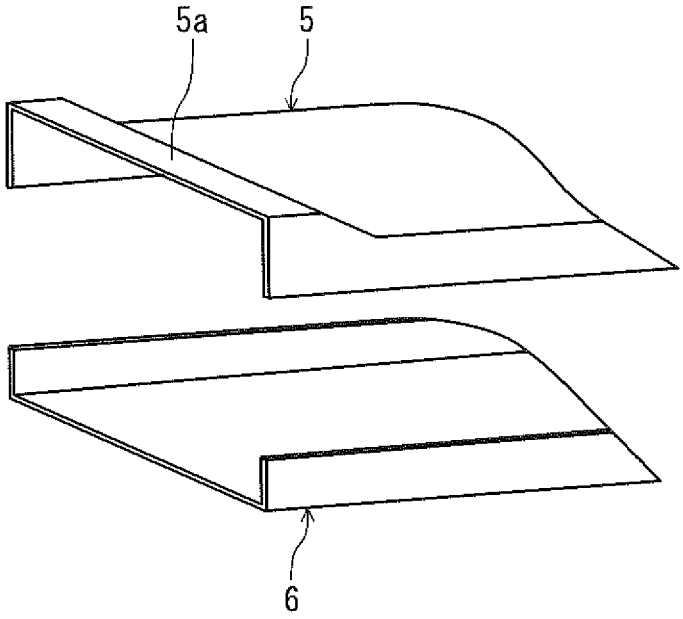
FIG. 4 is an exploded perspective view showing the tube.

Further, as shown in FIG. 4, since the construction is adopted in which the swollen portions 5*a* are provided only on the tube inner 5 while no swollen portion is provided on the tube outer 6, it is possible to reduce the total material cost and working cost which are needed to form the tube 4.

It is noted that on the contrary to the embodiment, a construction may be adopted in which swollen portions are provided only on the tube outer 6 while no swollen portion is provided on the tube inner 5.

<Other Embodiments>

In the embodiment described above, the beads 9 are formed on both the tube inner 5 and the tube outer 6, however, beads 9 may be provided only on either of them.

In addition, in the embodiment above, the total of seven beads 9, which are not connected to one another as shown in FIG. 3B, are formed. However, in the event that all the beads 9 are formed so as to continue to one another, the application robot can apply the brazing material continuously as in one continuous stroke to the grooves resulting from the provision of the beads 9 in the fabrication process of the tube 4. This can reduce the number of working man-hours, which in turn enhances the productivity of tubes 4.

Additionally, there is imposed no specific limitation on the shape of a bead 9 to be formed on the tube 4.

Figure 5A:
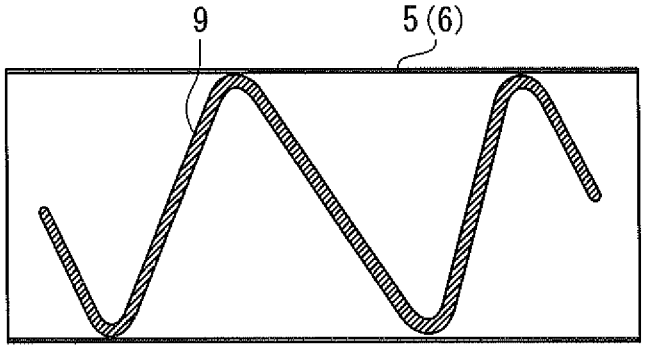
FIGS. 5A to 5D are explanatory plan views showing tubes of EGR coolers according to different embodiments.

For example, in a different embodiment shown in FIG. 5A, a bead 9 is provided to extend on a flat plate portion of a tube inner 5 or a tube outer 6 in a longitudinal direction while snaking.

Figure 5B:
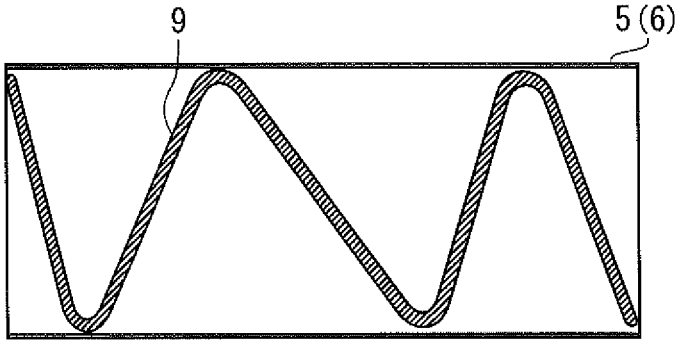

In another different embodiment shown in FIG. 5B, a bead 9 is provided to extend from a predetermined corner to a diagonal corner of a flat plate portion of a tube inner 5 or a tube outer 6 while snaking. In the beads 9 shown in FIGS. 5A and 5B, bends of the snaking bead 9 are radiused.

In the different embodiments shown in FIGS. 5A and 5B, since a single continuous groove resulting from the provision of the bead 9 is filled with a brazing material, in a fabrication process of a tube 4, an application robot can apply the brazing material continuously to the groove resulting from the provision of the bead 9 as in one continuous stroke, whereby the number of working man-hours can be reduced, enhancing the productivity of tubes 4.

In addition, since the bends of the snaking bead 9 are radiused, the application robot can apply the brazing material smoothly to the groove resulting from the provision of the bead 9 without involving a sharp turn, thereby making it possible to reduce the fabrication time.

Figure 5C:
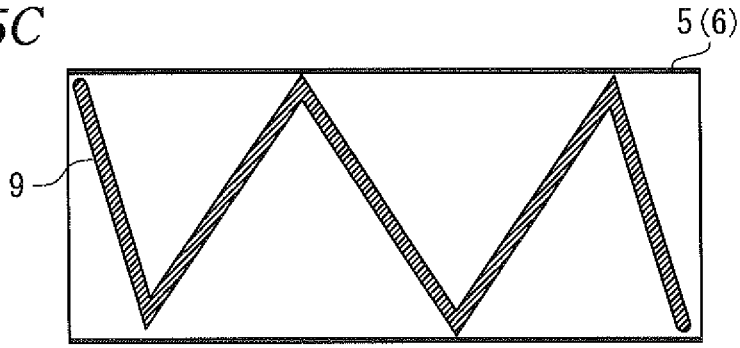

In a further different embodiment shown in FIG. 5C, a bead 9 is provided to extend from a predetermined corner to a diagonal corner of a flat plate portion of a tube inner 5 or a tube outer 6 while snaking.

Figure 5D:
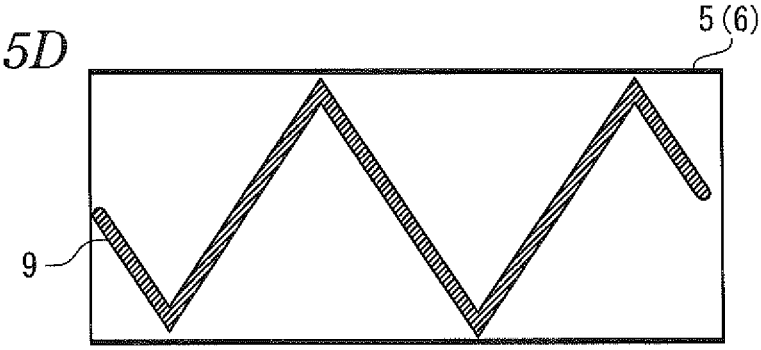

In a different embodiment shown in FIG. 5D, a bead 9 is provided to extend on a flat plate portion of a tube inner 5 or a tube outer 6 in a longitudinal direction while snaking.

In the beads 9 of FIGS. 5C and 5D, bends of the snaking bead 9 is formed into a sharp angle.

Also, in the different embodiments in FIGS. 5C and 5D, since a single continuous groove resulting from the provision of the bead 9 is filled with a brazing material, in a fabrication process of a tube 4, an application robot can apply the brazing material continuously to the groove resulting from the provision of the bead 9 as in one continuous stroke, whereby the number of working man-hours can be reduced, enhancing the productivity of tubes 4.

In addition, since the bends of the snaking bead 9 are formed into the angle, the total area of the groove resulting from the provision of the bead 9 can be reduced compared with the embodiments of FIGS. 5A and 5B and the amount of brazing material 10 to be used can be reduced, and thereby, the material cost can be reduced accordingly.

Figure 6A:
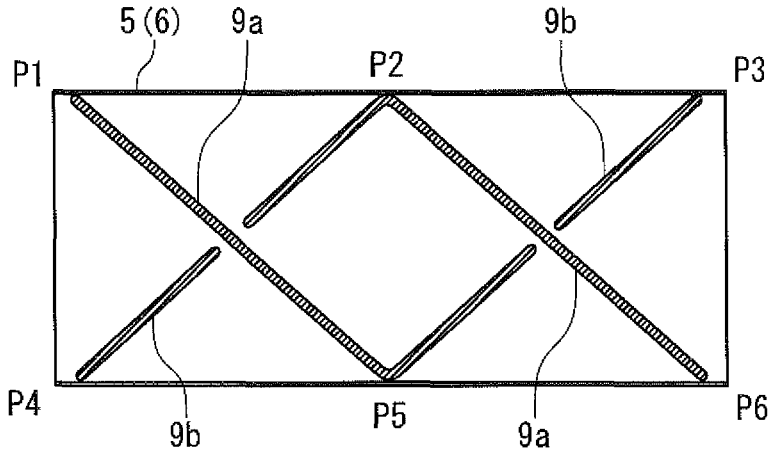
FIGS. 6A and 6B are explanatory plan views showing tubes of EGR coolers according to different embodiments.

In a different embodiment shown in FIG. 6A, a bead 9*a* is provided to extend in a straight line from a corner P1 to a longitudinally central and transversely opposite side position P5 of a flat plate portion of a tube inner 5 or a tube outer 6 and is then turned at this P5 towards a corner P3 to extend to a position which is situated substantially halfway up to P3. Additionally, a straight bead 9*b* is provided to extend from P3 to a position which is situated substantially halfway down to P5. A bead 9*a* is also provided to extend in a straight line from a corner P6 which is a diagonal corner of P1 to a longitudinally central and transversely opposite side position P2 and is then turned at this P2 towards a corner P4 to extend to a position which is situated substantially halfway down to P4. Additionally, a straight bead 9*b* is provided to extend from P4 to a position which is situated substantially halfway up to P2.

In the different embodiment of FIG. 6A, the two sets of the beads 9*a*, 9*b* are formed so that the one set is a reversal of the other or vice versa. Because of this, in forming beads 9*a*, 9*b* on the tube inner 5 or the tube outer 6 through pressing, one set of a bead 9*a* and a bead 9*b* is formed by using a die for the one set of the bead 9*a* and the bead 9*b*. Following this, the tube inner 5 or the tube outer 6 is turned through 180 degrees, and the remaining set of a bead 9*a* and a bead 9*b* can be formed by the same die. Thus, the fabrication cost can be reduced.

In addition, in a case where a flat plate portion is surrounded by a single large bead which continues without an interruption, after pressing, a deformation tends to be produced easily in a tube inner 5 or a tube outer 6 by a difference in elongation between an inside and an outside of the bead or residual stress. However, in the different embodiment of FIG. 6A, cuts are provided between the two beads 9*a* so that the two beads 9*a* do not continue to each other. This prevents a central portion of the flat plate portion from being surrounded by the beads 9*a* completely, and therefore, it is difficult for distortion or deflection to be produced in the tube inner 5 or the tube outer 6, thereby enhancing the press moldability thereof.

Figure 6B:
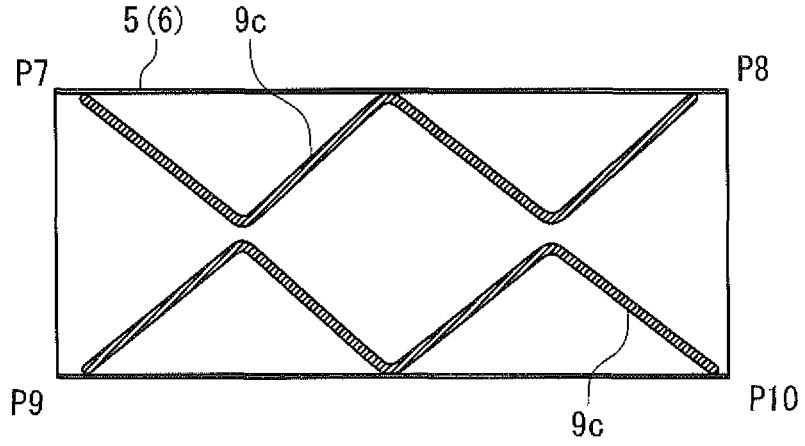
Figure 7B:
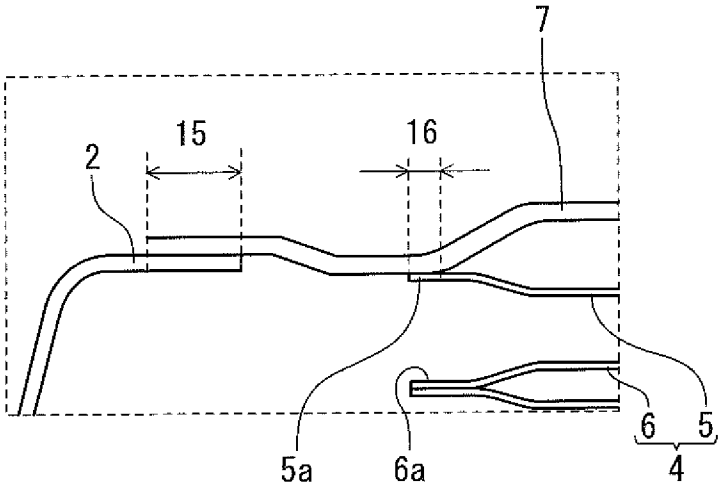
FIG. 7B is an enlarged view of a portion C in FIG. 7A.
Figure 7A:
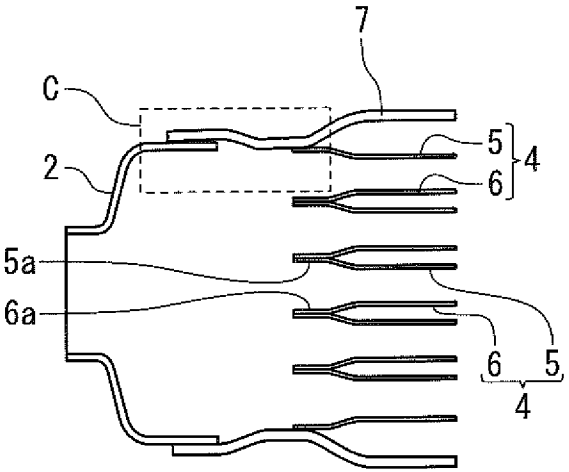
FIG. 7A is a partially enlarged explanatory view of a conventional EGR cooler.
Figure 8A:
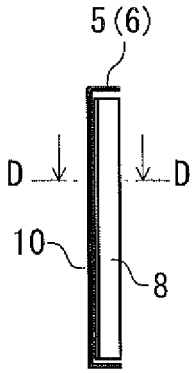
Figure 8B:
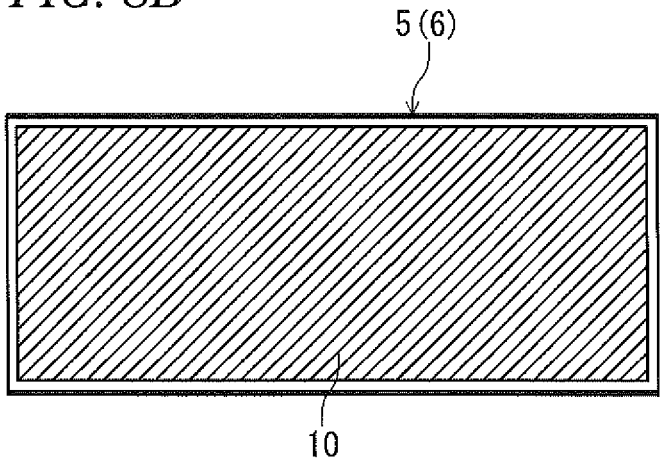
Figure 8C:
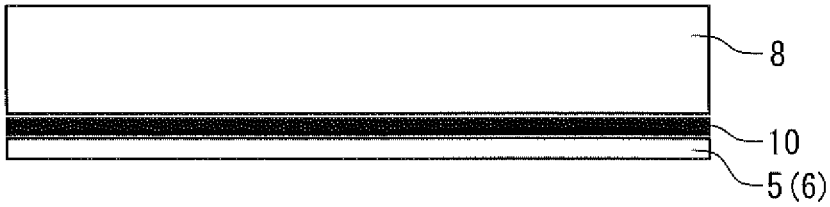
Figure 9:
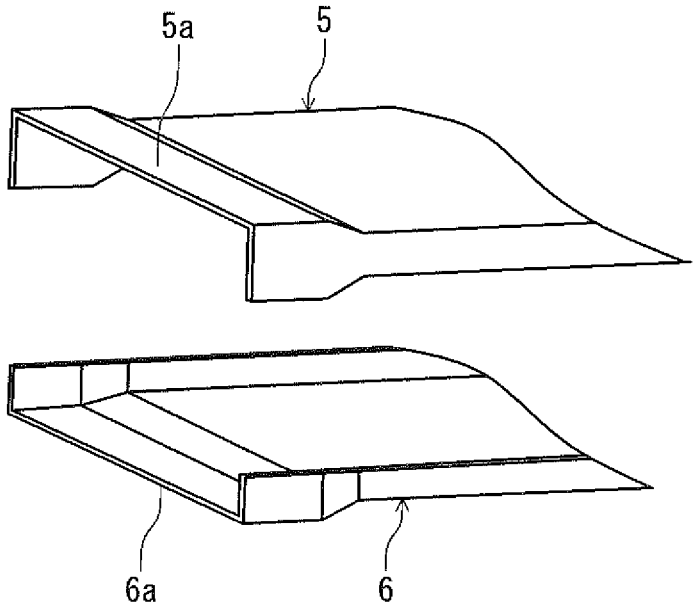
FIG. 9 is an exploded enlarged perspective view showing the tube of the conventional EGR cooler.

In another different embodiment of FIG. 6B, a bead 9*c* is provided to extend in a longitudinal direction on a flat plate portion of a tube inner 5 or a tube outer 6 from a corner P7 to a corner P8 while snaking. This bead 9*c* is formed so as to turn at a transversely center of the flat plate portion.

A bead 9*c* having the same shape is also provided to extend in the longitudinal direction from a diagonal corner P10 of P7 to a corner P9 while snaking.

In the different embodiment of FIG. 6B, the pair of beads 9*c* are formed so that one constitutes a reversal of the other or vice versa. Because of this, in forming beads 9*c* on the tube inner 5 or the tube outer 6 through pressing, one bead 9*c* is formed by using a die for the bead 9*c*. Following this, the tube inner 5 or the tube outer 6 is rotated through 180 degrees, and the remaining bead 9*c* can be formed by using the same die, thereby making it possible to reduce the fabrication cost.

In addition, in a case where a flat plate portion is surrounded by a single large bead which continues without an interruption, after pressing, a deformation tends to be produced easily in a tube inner 5 or a tube outer 6 by a difference in elongation between an inside and an outside of the bead or residual stress. However, in the different embodiment of FIG. 6B, cuts are provided between the two beads 9*c* so that the two beads 9*c* do not continue to each other. This prevents a central portion of the flat plate portion from being surrounded by the beads 9*c* completely, and therefore, it is difficult for distortion or deflection to be produced in the tube inner 5 or the tube outer 6, thereby enhancing the press moldability thereof.

While the invention has been described in detail and by reference to the specific embodiments, it is obvious to those skilled in the art to which the invention pertains that various alterations or modifications can be made thereto without departing from the spirit and scope of the invention.

This patent application is based on Japanese Patent Application No. 2011-261316 filed on Nov. 30, 2011, the contents of which are incorporated herein by reference.

DESCRIPTION OF REFERENCE NUMERALS

1: core portion; 2: inlet header; 2*a*: flange portion; 2*b*: downstream-side opening portion; 3: outlet header; 3*a*: upstream-side opening portion; 3*b*: flange portion; 4: tube; 5: tube inner; 5*a*: swollen portion; 6: tube outer; 6*a*: swollen portion; 7: shell; 8: inner fin; 9, 9*a*, 9*b*, 9*c*: bead; 10: brazing material; 11: cooling fluid inlet pipe; 12: cooling fluid outlet pipe; 13: joint portion; 14: portion not contributing to heat exchange; 15: joint portion (between a header and a shell); 16: joint portion (between a shell and a tube)

The invention claimed is:

1. An EGR cooler comprising:

a core portion having a plurality of tubes disposed therein, the plurality of tubes each having a flat shape through which exhaust gases pass, the tubes being stacked on one another in an interior of a hollow cylindrical shell and being configured to be joined to the shell, the core portion configured to provide heat exchange between the exhaust gases and a cooling fluid which flows around the tubes;

an inlet header having a cylindrical shape and joined at one end to an upstream side of the shell in relation to a gas flow, the inlet header configured to supply the exhaust gases into the core portion; and an outlet header having a cylindrical shape and joined at one end to a downstream side of the core portion in relation to the gas flow, the outlet header configured to discharge the exhaust gases from the core portion; wherein:

one of the tubes houses an inner fin having a corrugated shape, the inner fin configured to produce a turbulence of the exhaust gases; and the one of the tubes includes a first bead, in which a brazing material that connects the one of the tubes with the inner fin is provided, as a first groove formed in an inner surface of the one of the tubes, the first groove extending at a first angle greater than 0° and less than 90°, relative to the longitudinal direction of the cylindrical shell.

2. The EGR cooler of claim 1, wherein the one of the tubes further comprises a second bead formed as a second groove on the inner surface of the one of the tubes, the second groove extending at a second angle relative to the longitudinal direction of the cylindrical shell, the second angle being greater than 0° and different from the first angle.

3. The EGR cooler of claim 2, wherein the first groove and the second groove do not connect.

4. The EGR cooler of claim 2, wherein the second groove connects to an end of the first groove.

5. The EGR cooler of claim 2, wherein an imaginary line extending from and parallel to the first groove intersects an imaginary line extending from and parallel to the second groove.

6. The EGR cooler of claim 1, wherein the first groove extends across a width of the one of the tubes.

* * * * *